US006675513B2

(12) United States Patent
Liao

(10) Patent No.: US 6,675,513 B2
(45) Date of Patent: Jan. 13, 2004

(54) LIQUID ORNAMENT

(76) Inventor: Ho-Hsin Liao, No.7-5, Ln. 143, Sec. 1, Hsin-Sheng S. Rd., Taipei (TW)

( * ) Notice: Subject to any disclaimer, the term of this patent is extended or adjusted under 35 U.S.C. 154(b) by 0 days.

(21) Appl. No.: 10/373,833

(22) Filed: Feb. 27, 2003

(65) Prior Publication Data

US 2003/0172562 A1 Sep. 18, 2003

(51) Int. Cl.[7] ..... G09F 19/00

(52) U.S. Cl. ..... 40/426; 40/409; 40/410; 40/411; 40/414

(58) Field of Search ..... 40/426, 409, 410, 40/406, 411, 414; 446/267

(56) References Cited

U.S. PATENT DOCUMENTS 2,500,475 A * 3/1950 Starf ..... 40/426
3,006,111 A * 10/1961 Koch ..... 40/426
5,272,681 A 12/1993 Lee ..... 368/62
5,435,086 A * 7/1995 Huang ..... 40/426
5,620,353 A * 4/1997 Lai ..... 40/411
5,743,780 A * 4/1998 Liu ..... 40/406
6,357,151 B1 * 3/2002 Yuen ..... 40/426
6,388,953 B1 * 5/2002 Wu ..... 368/76
6,508,022 B2 * 1/2003 Huang ..... 40/426

* cited by examiner

*Primary Examiner*—Gary Hoge
(74) *Attorney, Agent, or Firm*—Bacon & Thomas, PLLC

(57) ABSTRACT

The present invention includes the basic components of traditional liquid ornament, which means an ornamental is in the "water ball". However, the ornamental in the present invention can achieve the effect of three-dimensional movement.

The present invention uses at least one string to connect the ornamental object with two passive magnetic objects (e.g. magnet, iron), so that the ornamental will move accordingly when two passive magnetic objects move. Furthermore, the relative position of two passive magnetic objects is also variable so that the ornamental can achieve the effect of three-dimensional movement.

3 Claims, 5 Drawing Sheets

LIQUID ORNAMENT

BACKGROUND OF THE INVENTION

1. Field of the Invention

The present invention relates to a liquid ornament, and more particularly to a liquid ornament having a movable ornament therein.

2. Description of the Related Art

The liquid ornament, also named "water ball", is a very traditional ornament and usually has at least one ornament object inside a sealed liquid vessel. Most of "water balls" do not provide the power to move the ornament objects. Few of "water balls" use mechanical energy providing device, such as a clock motor, a motor with music generation (musical movement, used a lots in Music Boxes), etc, to move ornament objects so that more amusing or entertaining effect can be generated. For example, U.S. Pat. No. 5,272,681, "Dynamic Fluid Clock", uses a clock motor to move its ornament object.

Please refer to FIG. 10 regarding the schematic view of U.S. Pat. No. 5,272,681. An ornament object 95 is connected with a magnet 93 by a string 94. There is another magnet 92 mounted on the second hand 91 of a clock motor. The magnet 93 is adhered to the magnet 92 due to the magnetic force so that when the second hand 91 moves, the magnet 92 and the magnet 93 will also move simultaneously. Therefore the ornament object 95 will also move accordingly in a manner of a circle movement.

However, it is not entertaining enough because the ornament object 95 move so regularly and also in a manner of two-dimensional movement only.

SUMMARY OF THE INVENTION

The main object of the present invention is to make the ornament in a liquid ornament achieve the effect of three-dimensional movement.

To achieve the object, the liquid ornament of the present invention includes a casing, a bottom casing, a base, at least one ornament, at least one liquid, and a mechanical energy providing device to provide mechanical energy for the ornament to move.

One of the subject matter of the present invention is that the liquid ornament further comprises two magnetic objects positioned under the bottom casing wherein the mechanical energy providing device can move these two magnetic objects. In addition, there are two passive magnetic objects positioned above the bottom casing and are adhered to two magnetic objects respectively due to the magnetic force. Therefore, once two magnetic objects move, and then two passive magnetic objects will move accordingly.

Another subject matter of the present invention is that the liquid ornament further comprises at least one string connected with the ornament and two passive magnetic objects so that the ornament moves accordingly. Therefore, the ornament can move in three-dimensional manner by changing the relative positions between two magnetic objects.

Other objects, advantages, and novel features of the invention will become more apparent from the following detailed description when taken in conjunction with the accompanying drawings.

ELEMENT DESCRIPTION

Figure 1:
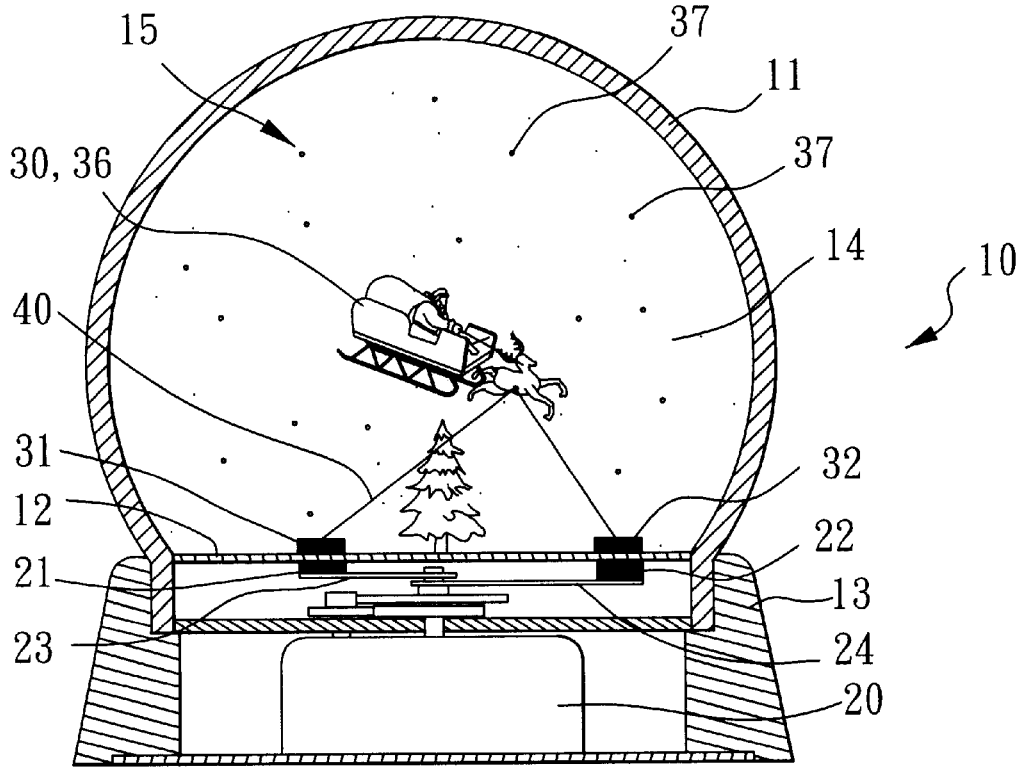
FIG. 1 shows a sectional view of a liquid ornament according to an embodiment of the present invention.

| | |
|---|---|
| the present invention | liquid ornament 10 |
| casing 11 | bottom casing 12 |
| base 13 | liquid 14 |
| sealed space 15 | mechanical energy providing device 20 |
| first magnetic object 21 | second magnetic object 22 |
| first rotary object 23 | second rotary object 24 |
| ornament 30 | first passive magnetic object 31 |
| second passive magnetic object 32 hole 35 | |
| Santa Claus ornament 36 | artificial snow 37 |
| string 40, 41~43 | second hand 91 |
| magnet 92, 93 | string 94 |
| ornament object 95 | |

DETAILED DESCRIPTION OF THE PREFERRED EMBODIMENT

Please refer to FIG. 1 for an embodiment of the present invention. The liquid ornament 10 of the present invention includes the basic components of traditional liquid ornament, such as a casing 11, a bottom casing 12, a base 13, at least one ornament 30 and at least one liquid 14. The casing 11 and the bottom casing 12 form a sealed space 15 in which the ornament 30 and the liquid 14 is contained. The liquid 14 usually uses water or oil. Multiple liquids are also very popular due to different designs of the liquid ornaments.

Since the liquid ornament 10 will provide the movable ornament 30, the liquid ornament 10 further comprises a mechanical energy providing device 20 which is positioned inside the base 13 and provides the mechanical energy for the ornament 30 to move. In the liquid ornament field, the popular mechanical energy providing devices are such as a clock motor, a motor with music generation (usually used in the music box), a motor, a motor with linkages, etc. In the present embodiment, the mechanical energy providing device 20 is a clock-type motor having a first rotary object 23 and a second rotary object 24 which are similar to a second hand and a minute hand. The rotation speed of the first rotary object 23 and the second rotary object 24, for example, could be 4 rpm and 7 rpm respectively. Please note that the rotation speed of the first rotary object 23 should be different from that of the second rotary object 24.

One of the subject matter of the present invention is that the liquid ornament 10 further comprises a first magnetic object 21, a second magnetic object 22, a first passive magnetic object 31, and a second passive magnetic object 32. The first magnetic object 21 is mounted on the first rotary object 23 and the second magnetic object 22 is mounted on the second rotary object 24. Therefore, two magnetic objects 21, 22 are positioned under the bottom casing 12. The first passive magnetic object 31 is positioned above the bottom casing 12, wherein the first passive magnetic object 31 is adhered to the first magnetic object 21 due to the magnetic force so that the first passive magnetic object 31 follows the movement of the first magnetic object 21 accordingly. Similarly, the second passive magnetic object 32 is positioned above the bottom casing 12, wherein the second passive magnetic object 32 is adhered to the second magnetic object 22 due to the magnetic force so that the second passive magnetic object 32 follows the movement of the second magnetic object 22 accordingly. The materials of two magnetic objects 21, 22 and two passive magnetic objects 31, 32 could all use magnets. However, other arrangements are also possible. For example, the materials of two passive magnetic objects 31, 32 use metals, and the materials of two magnetic objects 21, 22 use magnets. Please also note that, for the ornamental point of view, it is better to have ornaments mounted on the two passive magnetic objects 31, 32 (not shown).

Figure 5:
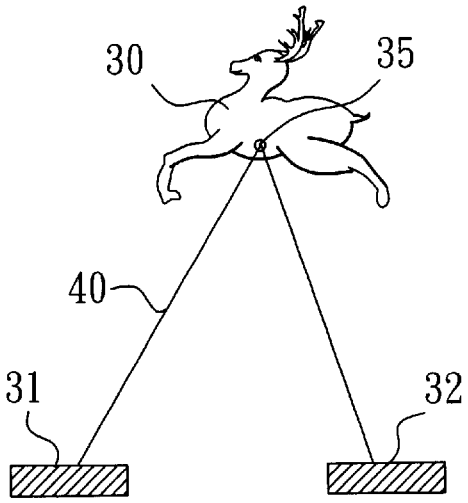
FIG. 5 shows schematically the connection between an ornament and passive magnetic objects.

Another subject matter of the present invention is that the liquid ornament 10 further comprises at least one string connected with the ornament 30, the first passive magnetic object 31 and the second passive magnetic object 32 so that the ornament 30 moves accordingly. Please also refer to FIG. 5. A string 40 passes through the hole 35 of the ornament 30 and connects with two passive magnetic objects 31, 32.

Figure 2:
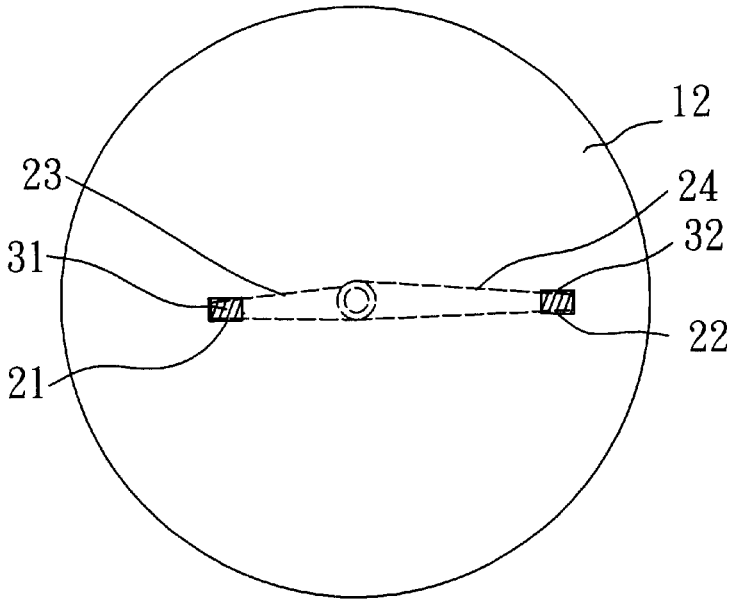
FIG. 2 shows schematically the position of two magnetic objects and two passive magnetic objects according to the FIG. 1.

Please also refer to FIG. 2. FIG. 2 shows schematically the position of two magnetic objects 21, 22 and two passive magnetic objects 31, 32 according to the top view of FIG. 1.

Figure 3:
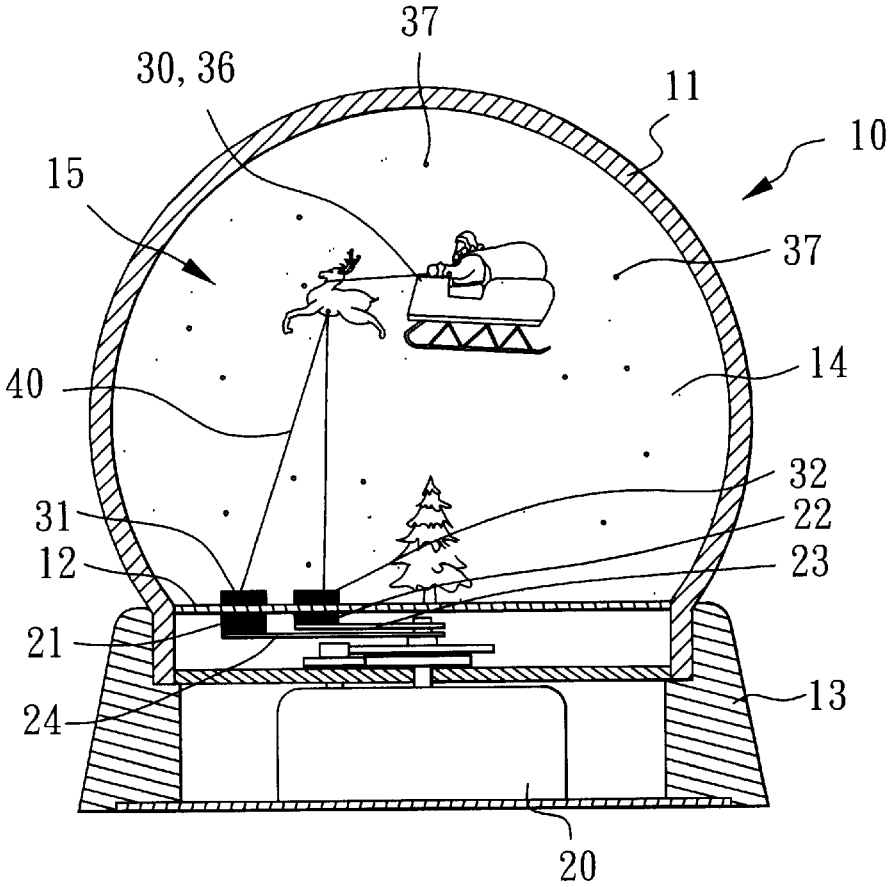
FIG. 3 shows another sectional view of a liquid ornament according to a first embodiment of the present invention, with different position of the ornament.
Figure 4:
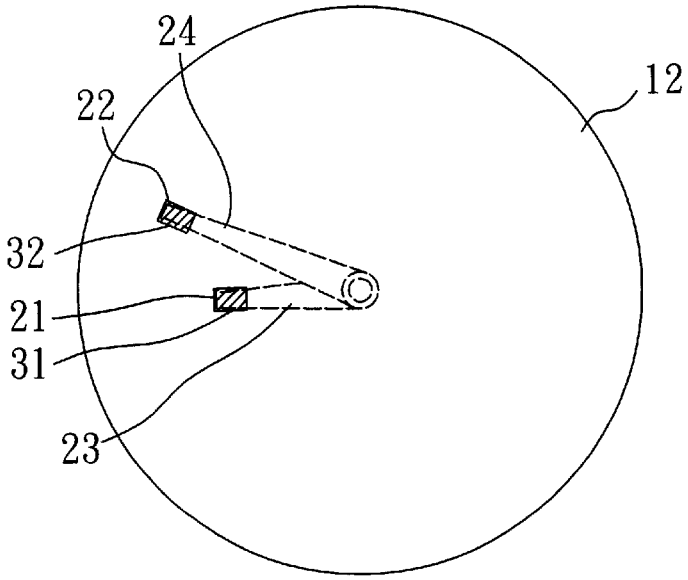
FIG. 4 shows schematically the position of two magnetic objects and two passive magnetic objects according to the FIG. 3.

FIG. 3 and FIG. 4 show the different position of the ornament 30 from that of FIG. 1 and FIG. 2. Because the position of two magnetic objects 21, 22 and two passive magnetic objects 31, 32 change so that the position of the ornament 30 changes accordingly. Because the distance between two passive magnetic objects 31, 32 is closer in FIG. 3 and FIG. 4, the position of the ornament 30 is higher compared to that of the ornament 30 shown in FIG. 1 and FIG. 2.

The above explanations show that the present invention can make the ornament 30 move in three-dimensional manner by changing the relative positions between two magnetic objects 21, 22. The ornament 30 could be a Santa Claus ornament 36 and many artificial snows 37 can be put in the liquid 14. Therefore, artificial snows can be brought up when the Santa Claus ornament 36 moves. On the other hand, the rotation speed of the first rotary object 23 and the second rotary object 24 can be cleverly arranged, for example, could be 4 rpm and 7 rpm respectively. Thus, the cycle of the movement pattern is 28 minutes (4 times 7) of the ornament 30 so that the movement of the ornament 30 will look like a irregular movement.

FIGS. 6–9 shows schematically a series of variations of the connection between the ornament 30 and two passive magnetic objects 31, 32.

Figure 6:
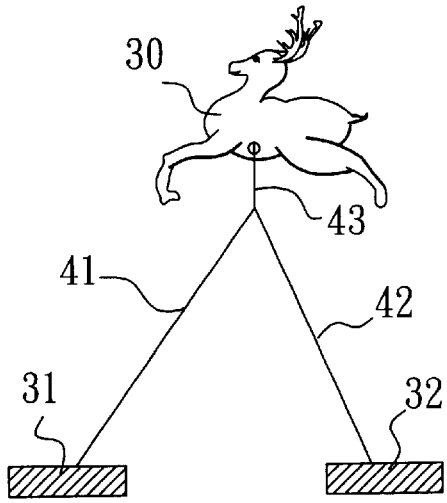
FIGS. 6–9 shows schematically a series of variations of the connection between an ornament and passive magnetic objects.

FIG. 6 shows three string 41~43 to connect the ornament 30 and two passive magnetic objects 31, 32.

Figure 7:
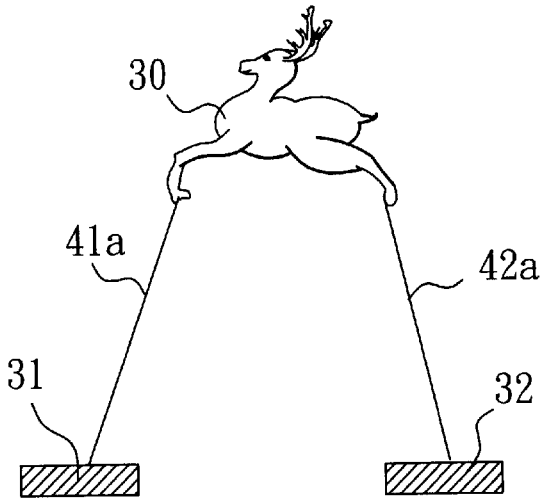

FIG. 7 shows three string 41*a*~42*a* to connect the ornament 30 and two passive magnetic objects 31, 32.

Figure 8:
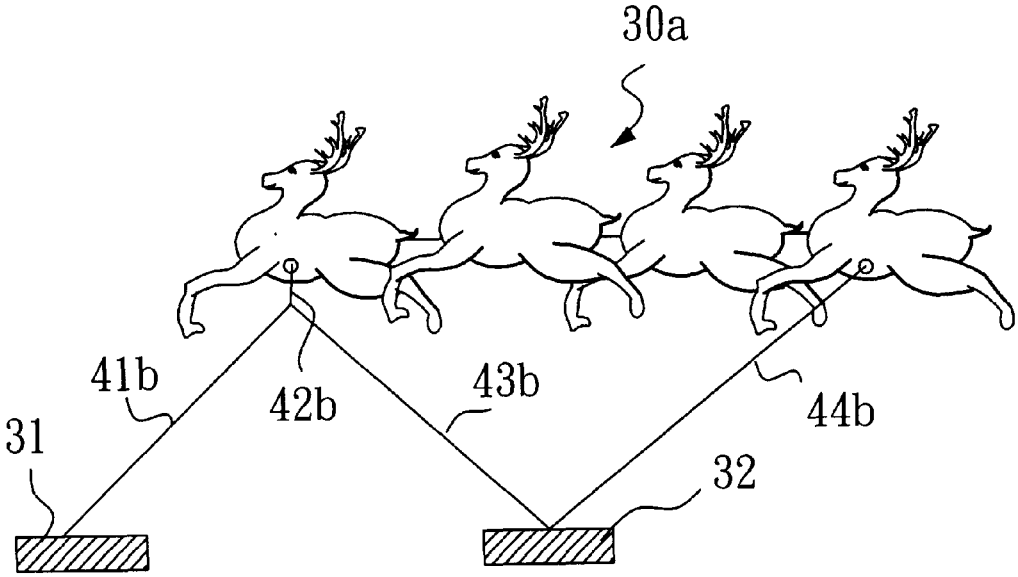

FIG. 8 shows a ornament with longer shape, such as four dears 30*a* and uses four string 41*b*~44*b* to connect the ornament 30*a* and two passive magnetic objects 31, 32.

Figure 9:
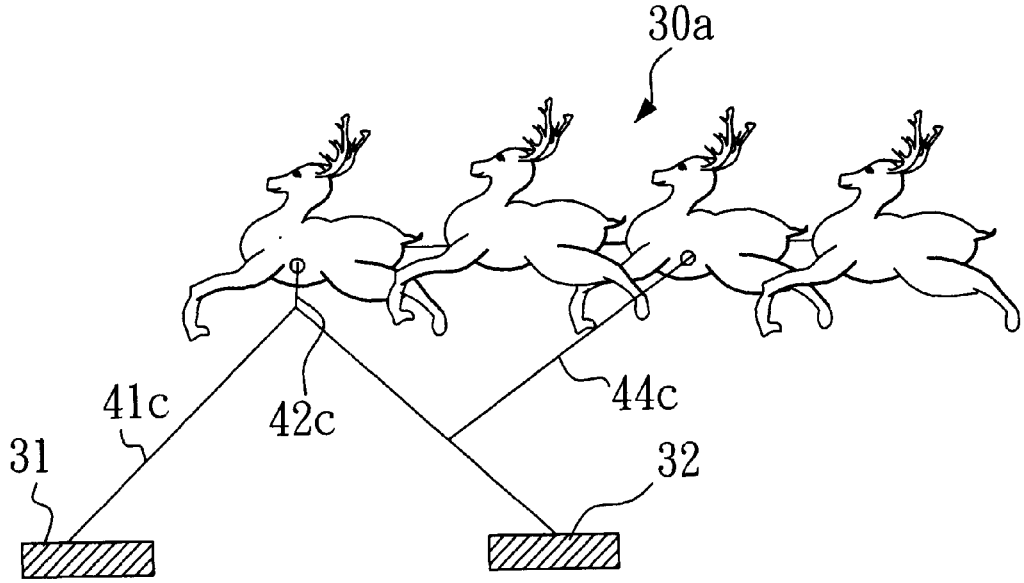
Figure 10:
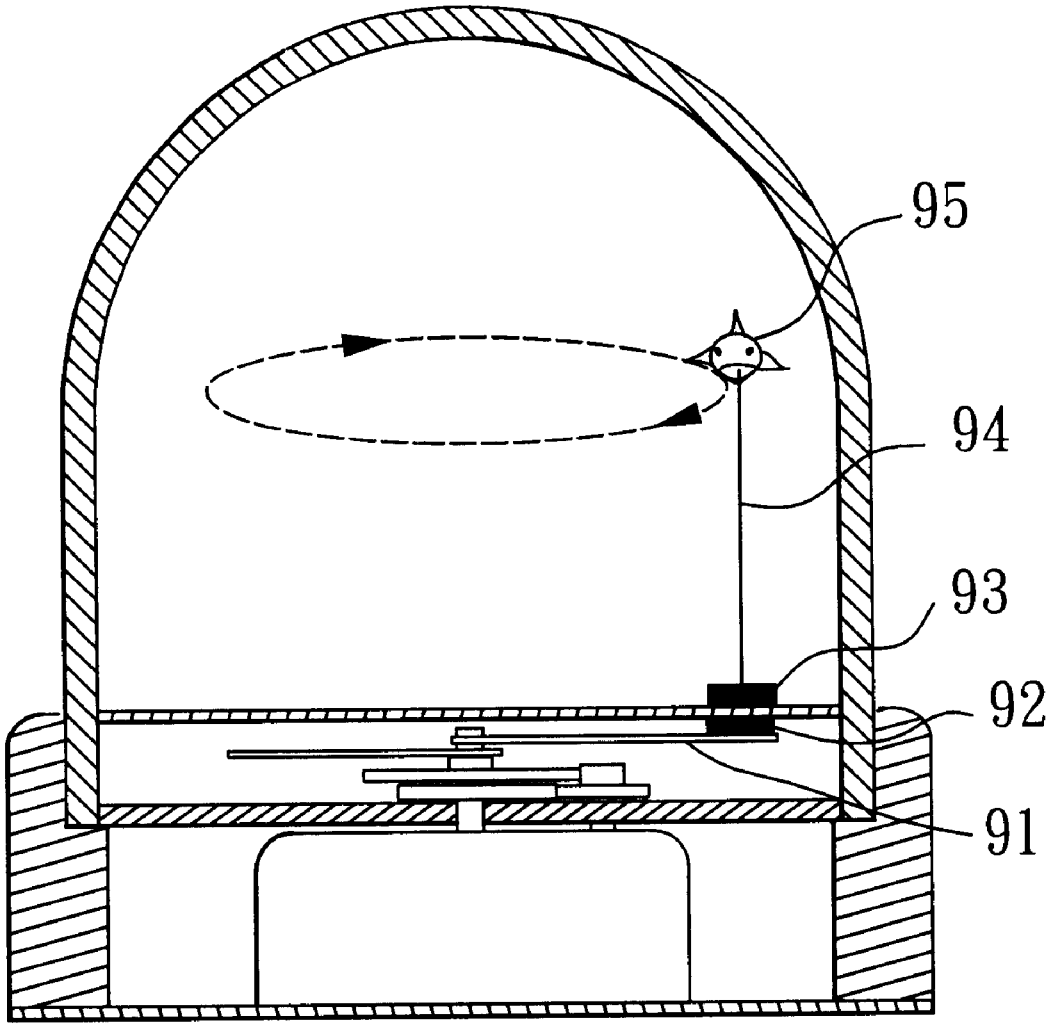
FIG. 10 PRIOR ART
FIG. 10 shows a prior art of a liquid ornament.

FIG. 9 also uses four string 41*c*~44*c*, with different way, to connect the ornament 30*a* and two passive magnetic objects 31, 32.

FIGS. 5–9 show that there are many ways to use one or multiple string to connect the ornament 30*a* and two passive magnetic objects 31, 32.

Although the present invention has been explained in relation to its preferred embodiment, it is to be understood that many other possible modifications and variations can be made without departing from the spirit and scope of the invention as hereinafter claimed. For example, for those of reasonable skill in the art, it is very easy to use other mechanisms to change the relative positions between two magnetic objects 21, 22. It is also very easy to find a suitable mechanical energy providing devices. Please also note the mechanical energy can be obtained through electric (e.g. battery) or other mechanical energy (e.g. manpower when using a motor with music generation).

What is claimed is:

1. A liquid ornament having a casing, a bottom casing, a base, a mechanical energy providing device, an ornament and at least one liquid, wherein the casing and the bottom casing forms a sealed space in which the ornament and the liquid is contained, and the mechanical energy providing device is positioned inside the base characterized in that the liquid ornament further comprises:

a first magnetic object positioned under the bottom casing, wherein the mechanical energy providing device can move the first magnetic object;

a second magnetic object positioned under the bottom casing, wherein the mechanical energy providing device can move the second magnetic object, and the relative position of the first magnetic object and the second magnetic object is variable;

a first passive magnetic object positioned above the bottom casing, wherein the first passive magnetic object is adhered to the first magnetic object due to the magnetic force so that the first passive magnetic object follows the movement of the first magnetic object accordingly;

a second passive magnetic object positioned above the bottom casing, wherein the second passive magnetic object is adhered to the second magnetic object due to the magnetic force so that the second passive magnetic object follows the movement of the second magnetic object accordingly; and at least one string connected with the ornament, the first passive magnetic object and the second passive magnetic object so that the ornament moves accordingly.

2. The liquid ornament as claimed in claim 1, wherein the mechanical energy providing device further comprises a first rotary object and a second rotary object, wherein the first magnetic object is mounted on the first rotary object and the second magnetic object is mounted on the second rotary object, and the rotation speed of the first rotary object is different from that of the second rotary object, such that the relative position of the first magnetic object and the second magnetic object is variable.

3. The liquid ornament as claimed in claim 1, wherein the ornament is the Santa Claus ornament.

* * * * *